United States Patent [19]

Mon

[11] Patent Number: 4,934,409

[45] Date of Patent: Jun. 19, 1990

[54] T JUNCTION INTERCONNECTED MULTISTAGE FLUIDIC GAINBLOCK

[75] Inventor: George Mon, Potomac, Md.

[73] Assignee: The United States of America as represented by the Secretary of the Army, Washington, D.C.

[21] Appl. No.: 459,847

[22] Filed: Jan. 2, 1990

[51] Int. Cl.[5] ..... F15C 1/00

[52] U.S. Cl. ..... 137/819; 137/840

[58] Field of Search ..... 137/819, 840, 834

[56] References Cited

U.S. PATENT DOCUMENTS

| | | | |
|---|---|---|---|
| 3,503,423 | 3/1970 | Edell | 137/819 |
| 3,568,702 | 3/1971 | Dustin | 137/819 |
| 3,570,511 | 3/1971 | Bermel | 137/819 |
| 3,717,164 | 2/1973 | Griffin | 137/819 |
| 4,833,880 | 5/1989 | Chapin | 137/840 |

FOREIGN PATENT DOCUMENTS

| | | | |
|---|---|---|---|
| 835154 | 2/1970 | Canada | 137/820 |
| 1236565 | 6/1971 | United Kingdom | 137/819 |

*Primary Examiner*—A. Michael Chambers

*Attorney, Agent, or Firm*—Saul Elbaum; Paul S. Clohan

[57] ABSTRACT

A fluidic gainblock for amplifying AC pressure signals having an additional element known as a "T" junction added to the interconnection region between the stages of an LPA gainblock. Where normally there would be direct coupling between LPA's in a staged gainblock, there is now provided a path for the interstage flow noise and DC bias to exit prior to entering the next stage. This gainblock now allows as many stages to be added as needed in a gainblock as the elimination of the DC bias prevents the saturation of the gainblock. Interconnection flow noise is now minimized or eliminated completely and only the pressure signal is allowed to enter the next stage via the perpendicular branch of the "T" junction.

6 Claims, 2 Drawing Sheets

T JUNCTION INTERCONNECTED MULTISTAGE FLUIDIC GAINBLOCK

RIGHTS OF THE GOVERNMENT

The invention described herein may be manufactured, used and licensed by or for the United States Government for Governmental Purposes without payment to me of any royalty thereon.

BACKGROUND OF THE INVENTION

The present invention relates to amplification of AC fluidic signals and more particularly to a method for reduction of flow noise and DC bias between stages of Laminar Proportional Amplifiers.

The technology known as fluidics provides sensing, computing, and controlling functions with fluid power through the interaction of fluid (liquid or gas) streams. Consequently, fluidics can perform these functions without mechanical moving parts. The inherent advantages of fluidics are, therefore, simplicity and reliability, since there are no moving parts.

Since 1970, a number of important applications of fluidics have been realized. The areas of use include the aerospace industry, medicine, personal-use items, and factory automation. Fluidics for military systems has also progressed to the point where several systems are now in use. In most cases, the reason for selecting fluidics has been a combination of low cost, high reliability, inherent safety, and the ability to operate in severe environments.

Almost all early (first generation) fluidic devices were operated in the turbulent-flow regime. Since the mid-1970's, the emphasis has shifted to the use of laminar-flow (second generation) fluidic components. Turbulent flow is characterized by a "noisy" jet; in contrast, laminar flow is characterized by a "quiet" well-defined jet. Laminar-flow fluidic devices are used primarily in signal applications where the ability to detect and process extremely small pressure signals is essential.

Most fluidic amplifiers have at least four basic functional parts. These include (1) a supply port, (2) one or more control ports, (3) one or more output ports, and (4) an interaction region. These sections may be compared, respectively, to the cathode, control grid, plate, and interelectrode region of a vacuum tube. Many fluidic amplifiers also contain vents to isolate the effects of output loading from the control flow characteristics.

The supply jet in the fluidic amplifier passes into the interaction region where it is directed toward the output port(s) or receiver(s). Control flow injected into the interaction region determines the direction and distribution of the supply flow, which in turn affects the flow reaching the receiver(s). The amount of pressure or flow recovery available in a receiver is determined by the internal shape of the device. Useful amplification occurs inasmuch as change in output energies can be achieved with small changes in control energies.

Laminar proportional amplifiers (LPA's) and sensors are active (flow consuming) devices that form the building blocks of fluidic control systems. A typical application requires several of these active devices interconnected to perform a specific control function. Generally they are packaged to provide a means to interconnect these devices, distribute the supply and vent flow, and accommodate additional components such as flow restrictors and volumes required to accomplish various control functions. The most convenient configuration is to use a planar element format which has two flat sides.

Staging is the process of connecting two or more amplifiers in series to obtain an increase in gain. An LPA has a pressure gain, i.e., a small change in pressure at the inputs produces a larger change in pressure at the outputs. The pressure gain is at a maximum when no flow is delivered at the outputs (blocked load). Pressure gain decreases as flow is withdrawn from the amplifier outputs. If the amplifier outputs are wide open, the pressure gain is essentially zero. An LPA also has flow gain; a small change in flow at the inputs produces a larger change in flow at the outputs. Flow gain is maximum when the amplifier outputs are wide open, and is zero when the amplifier is operated block loaded. Since power is defined as the product of pressure and flow, an LPA also has power gain.

Of the three gains described above, staging for pressure gain is the most common requirement. There are several methods of staging LPA's to obtain pressure gain. For example, amplifiers can be self-staged by connecting identical elements all operating at the same supply pressure. This practice is convenient for assembly and manifolding and for maximizing the input/output resistance ratio; however, dynamic range is not optimized. Dynamic range is related to the maximum available output signal which, for LPA's, increases with an increase in supply pressure. If two identical amplifiers operating at the same supply pressure are staged, the first amplifier will saturate the second amplifier before the first amplifier reaches its own saturation level. Thus, the full dynamic range of the first amplifier is not being used. In some applications, the single-stage amplifier dynamic range is high enough so that a self-staged reduction in dynamic range can be tolerated.

Thus it can be seen from the above discussion that it is well known in the art that LPA's can be staged to form gainblocks with high pressure gain and dynamic range. In a conventionally staged gainblock, the output flows from the previous stage are directed to flow completely into the input ports of the next stage. As a result, flow noise is generated within the interconnection region by the interaction of the fluid molecules with the wall of the interconnection passage and this flow noise is amplified by the next stage. This amplified flow noise can significantly reduce the signal-to-noise ratio in the output signal. In addition to flow noise, DC bias, present in any conventionally staged gainblock, interferes with the output signal. When LPA's are staged to form a gainblock, the DC bias from the previous stage can saturate the gainblock. It is, therefore, very difficult to build a gainblock with more than four stages without carefully matching the bias characteristics of each LPA.

When conventionally staged gainblocks are used to sense very low pressure signals, the interstage flow noise generally overwhelms the input signals. As a result, it is impossible to detect any output signal at the output ports without signal processing and filtering. It can be seen, therefore, that there is a great need to devise a new staging method for LPA's so that interstage flow noise and DC bias is reduced or eliminated.

OBJECTS AND SUMMARY OF THE INVENTION

It is therefore the primary object of the present invention to reduce the interstage flow noise between the stages of an LPA gainblock.

Another object of this invention is to eliminate the DC bias between stages of an LPA gainblock.

A further object of this invention is to improve the performance of the LPA gainblock at low signal inputs.

In the present invention, an additional element known as a "T" junction is added in the interconnection region between the stages of an LPA gainblock. Thus where normally there would be direct coupling between LPA's in a staged gainblock, there is now provided a path for the interstage flow noise and DC bias to exit prior to entering the next stage. The present invention now allows as many stages to be added as desired in a gainblock as the elimination of the DC bias prevents the saturation of the gainblock. Interconnection flow noise is now minimized or eliminated completely and, only the pressure signal is allowed to enter the next stage via the perpendicular branch of the "T" junction.

DETAILED DESCRIPTION OF THE PREFERRED EMBODIMENTS

Figure 1:
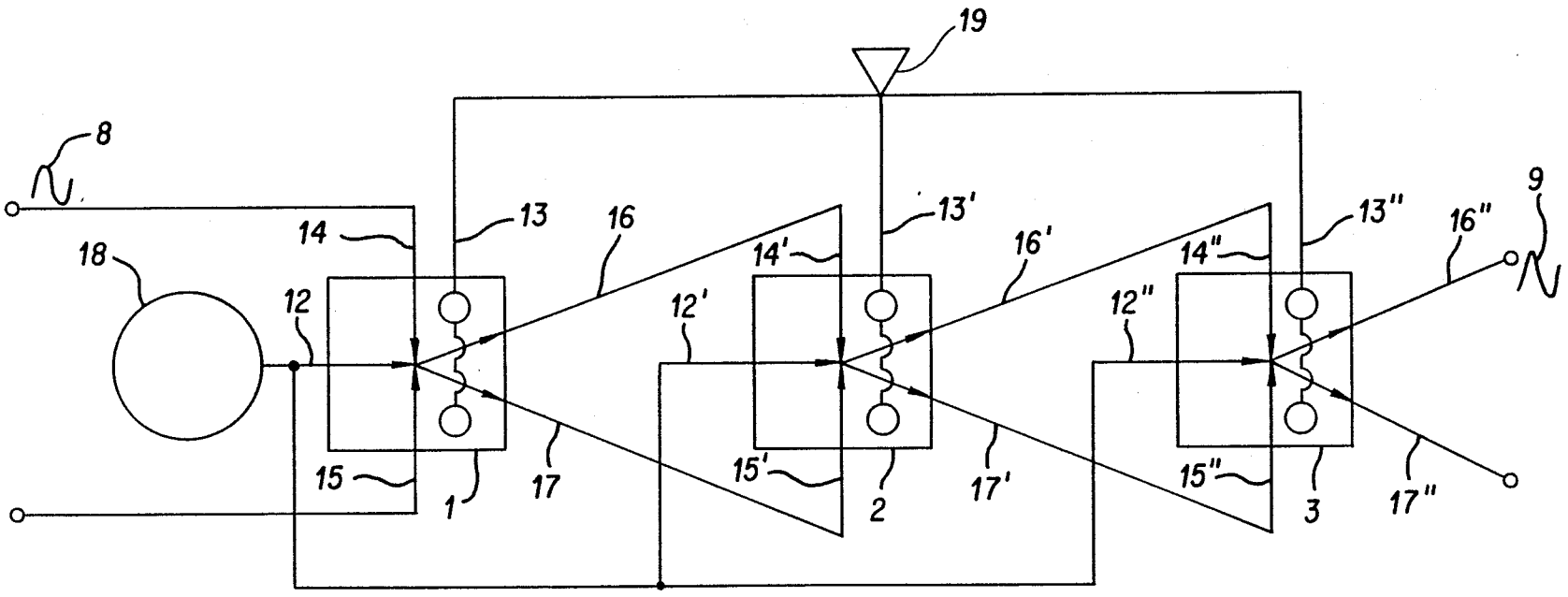
FIG. 1 PRIOR ART
FIG. 1 is a schematic diagram illustrating the prior art method of staging an LPA gainblock.

Referring now to FIG. 1 there is shown a typical prior art arrangement of staging an LPA gainblock by the use of a plurality of series-connected, staged, fluidic amplifiers. By way of example, three laminar proportional amplifiers 1, 2, and 3 are shown schematically, of which the construction of each is well known in the prior art. Each has an inlet connection 12 leading to the nozzle, and outlet 13 leading from the vents, two amplifier input connections 14 and 15 leading to the control ports and two output connections 16 and 17 leading from the fluid receivers. A fluid supply 18 communicates with the inlets 12, 12' and 12'' of the three amplifier stages and an vent connection 19 communicating the connections 13, 13' and 13''. It will be noted that the amplifier output connections 16 and 17 for amplifier 1 are connected to the amplifier input connections 14' and 15' of amplifier 2. Similarly, the output connections 16' and 17' of amplifier 2 are connected to the input connections 14'' and 15'' of amplifier 3 so that all three amplifier stages are connected in series. In an AC gainblock, input signal 8 is generally injected into only one input port of the first LPA in the gainblock, in this example input port 14. The other input port 15 is generally grounded or otherwise balanced. The signal travels through the gainblock, is amplified by each stage, and exits from the last output port of the last LPA as an output signal, in this case output signal 9 from output port 16. As the signal travels through the gainblock, interconnection flow noise and DC bias is present in output passages 16, 16', 16'' and 17, 17' and 17''. The interconnection flow noise as well as the signal is amplified by each successive stage, and the DC bias prevents the addition of additional stages to the gainblock.

Figure 2:
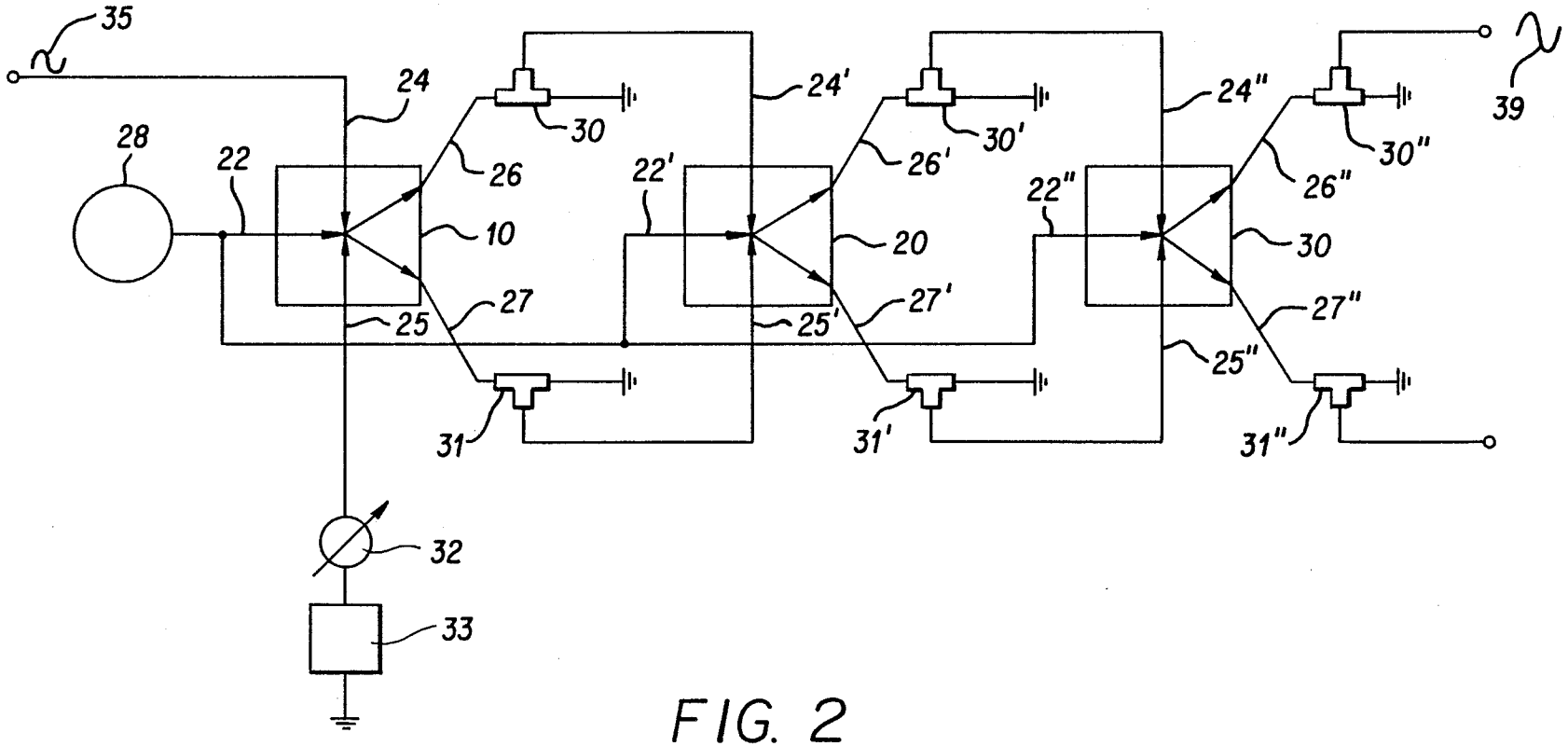
FIG. 2 is a schematic diagram illustrating the present inventive method of staging an LPA gainblock.

FIG. 2 shows a schematic diagram of the staging of an LPA gainblock using the present inventive method. As in the prior art method, three fluidic amplifiers 10, 20, and 30 are used for purposes of illustration only. More or less than three LPA's can be successfully used in the present method, and, as will be shown later, significantly more than three LPA's can be staged using the present inventive method. Each LPA has an inlet connection 22 leading to the nozzle. For the purpose of simplification, the vent connections are not shown in FIG. 2, but can be the same as in the prior art method described above. As in the prior art, each LPA also has two amplifier inputs 24 and 25 leading to the control ports and two output connections 26 and 27 leading from the fluid receivers. A fluid supply 28 communicates with the inlets 22, 22' and 22'' of the three amplifier stages to power the gainblock.

Instead of the direct interconnection between stages that is used in the prior art, the present inventive method employs a "T" junction 30 and 31 between stages, which grounds the output flow from the previous stage through the straight section in the "T" junction and allows the signal to pass through the perpendicular section. For example, output connection 26 from LPA 10 is connected to the horizontal branch of "T" junction 30, where the output flow from LPA 10 is grounded through the straight (horizontal) section of "T" junction 30 and the output pressure signal (which is an amplification of AC input signal 35 in this gainblock) is picked up at the perpendicular branch of "T" junction 30 and will continue to input 24' of LPA 20. As a result of this method of staging, there will be little or no DC flow allowed to flow into the input port of the next stage. Thus not only is the DC bias eliminated but the interconnection flow noise is now minimized or eliminated and only the pressure signal is allowed to enter the next stage via the perpendicular branch of the "T" junction. Because the DC bias flow has been eliminated between stages any number of stages can be added as needed without encountering the problem of saturating the gainblock due to the cumulative effect of the DC bias flow.

As noted above, the output pressure signal of this AC gainblock is picked up at the perpendicular branch of the "T" junction. For most low-pressure signal applications, only one input port is needed to sense the signal. Thus AC input signal 35 is fed into input port 24 and it becomes necessary to isolate the other unused signal port as shown in FIG. 2. In this instance, unused input port 25 of LPA 10 is grounded with variable resistor 32 and a fixed volume tank 33. The purpose of this particular arrangement is to prevent any environmental noise from entering unused input port 25 in the first stage (LPA 10) of the AC gainblock and to balance the amplifier for different input probes presented to input port 24. It should be noted that this AC gainblock could easily be used as a conventional LPA gainblock by blocking the DC flow in the "T" junctions.

As input signal 35 travels through the gainblock, it continues to be amplified by each successive stage and emerges from output port 26 of final LPA 30 and is picked-off from the vertical branch of "T" junction 30'' as output signal 39. Between each stage of the gainblock. "T" junctions are utilized to eliminate the DC bias and interconnection flow noise allowing the gainblock to operate more efficiently, especially when very small input signals are involved.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A fluidic gainblock for amplifying an AC pressure signal comprising:

a plurality of staged laminar proportional amplifiers interconnected such that the outputs of each stage are connected to the inputs of each succeeding stage through a "T" junction interposed between said interconnected laminar proportional amplifiers;

a fluidic supply source connected to the input supply ports of said plurality of laminar proportional amplifiers.

2. The device of claim 1 wherein the outputs of each stage are connected to the inputs of each succeeding stage through the horizontal branch of said "T" junction interposed between said interconnected laminar proportional amplifiers.

3. The device of claim 1 wherein the outputs of each stage are connected to the horizontal branch of said "T" junction and the inputs of each succeeding stage are connected to the vertical branch of said "T" junction.

4. A fluidic gainblock for amplifying an AC pressure signal comprising:

a first, second, and third laminar proportional amplifier each having a first input port, a second input port, a supply port, a first output port and a second output port;

a fluidic supply source connected to said supply port of each of said laminar proportional amplifiers.

an AC pressure signal source injected into said first input port of said first laminar proportional amplifier;

a variable resistor and a fixed volume tank connected to said second input port of said first laminar proportional amplifier;

a first, second, third, fourth, fifth and six "T" junction each having a horizontal branch and a vertical branch;

said first output port of said first laminar proportional amplifier connected to said horizontal branch of said first "T" junction and said first input port of said second laminar proportional amplifier connected to said vertical branch of said first "T" junction;

said second output port of said first laminar proportional amplifier connected to said horizontal branch of said second "T" junction and said second input port of said second laminar proportional amplifier connected to said vertical branch of said second "T" junction;

said first output port of said second laminar proportional amplifier connected to said horizontal branch of said third "T" junction and said first input port of said third laminar proportional amplifier connected to said vertical branch of said third "T" junction;

said second output port of said second laminar proportional amplifier connected to said horizontal branch of said fourth "T" junction and said second input port of said third laminar proportional amplifier connected to said vertical branch of said fourth "T" junction;

said first output port of said third laminar proportional amplifier connected to said horizontal branch of said fifth "T" junction and said second output port of said third laminar proportional amplifier connected to said horizontal branch of said sixth "T" junction;

an AC pressure output signal at said vertical branch of said fifth "T" junction.

5. A method for the reduction of DC bias and interconnection flow noise in staged laminar proportional amplifier gainblocks used to amplify AC acoustic signals comprising:

interconnecting a plurality of laminar proportional amplifiers thereby forming a staged gainblock;

means provided between stages for said DC bias to exit said gainblock and said AC acoustic signal to continue on to the next stage of said gainblock.

6. The method of claim 5 wherein said means provided between stages for said DC bias to exit said gainblock and said AC acoustic signal to continue on to the next stage of said gainblock is a "T" junction.

* * * * *